United States Patent [19]

Tatevosian et al.

[11] 4,378,050

[45] Mar. 29, 1983

[54] ARRANGEMENT FOR FULL HOLE DRILLING

[76] Inventors: Ruben A. Tatevosian, ulitsa Gorkogo, 4, kv. 60, Moscow; Nikolai K. Lipatov, ulitsa Zinovieva, 2, kv. 96, Apatity, Murmanskaya oblast, both of U.S.S.R.

[21] Appl. No.: 302,858

[22] Filed: Sep. 16, 1981

[51] Int. Cl.[3] ..... E21B 33/17; E21B 7/00

[52] U.S. Cl. ..... 166/309; 166/164; 166/286; 175/72; 175/237

[58] Field of Search ..... 166/162, 164, 278, 280, 166/285, 286; 175/72, 308, 309, 237

[56] References Cited

U.S. PATENT DOCUMENTS 2,778,603 1/1957 McCune et al. ..... 166/278 X
2,880,969 4/1959 Williams ..... 175/226
3,362,476 1/1968 Van Poollen ..... 175/72 X
4,191,254 3/1980 Baughman et al. ..... 175/72

*Primary Examiner*—Stephen J. Novosad
*Assistant Examiner*—Joseph Falk
*Attorney, Agent, or Firm*—Burgess, Ryan and Wayne

[57] ABSTRACT

An arrangement for full hole drilling, wherein a drilling bit having a passage for drilling fluid is attached to a drill pipe string. A hole wall former is provided above the bit for closing the space between the hole walls and the drill pipe string. A container containing a plugging material is provided in the interior of the drill pipe string immediately above the bit, which is adapted to let drilling fluid between the walls of said container and said drill pipe string. The bit has an axial bore of a diameter which is greater than the inside diameter of the container and which is adapted to receive the lower end of said container.

5 Claims, 3 Drawing Figures

ARRANGEMENT FOR FULL HOLE DRILLING

The present invention relates to arrangements for drilling holes, and more particularly, to arrangements for full hole drilling without coring.

There is presently wide use of full hole drilling of oil, gas, and water production wells, as well as for drilling prospective structural holes and exploratory holes in gas-bearing and oil-bearing regions, in supra-ore strata in detailed exploration of deposits with well-studied and comparatively simple structure, overburdening loose deposits in drilling mapping, prospecting and exploration holes, in rocks of the platform mantle in explorations of deposits extending in the Pre-Cambrian platform base, hydrogeological, seismic and blasting holes.

Two-, three- and four-roller rock bits and four-roller drill heads are most widely used in full hole drilling. When operating under optimal conditions, these bits make it possible to develop very high mechanical drilling speeds.

In full hole drilling, as well as in drilling by any other method, complications frequently occur which are caused by an instability of rocks forming the hole walls, water inflows and especially absorption of drilling fluid in seamy and vesicular rocks and in rocks exhibiting high permeability. These complications disrupt optimal drilling conditions, substantially lower the drilling speed and frequently cause complete suspension of drilling until the complication is eliminated. This results in lower productivity and considerable increase in the hole cost so that effective methods of fighting complications represent one of the most important problems in drilling.

In the majority of cases the process of hole drilling is suspended for a time during which the complication is eliminated; however, there are techniques for eliminating complications which may be implemented without interruptions of the hole drilling. Using such techniques, a plugging material is added to drilling fluids in the form of jelly-like polymeric clots filled with a finely divided material, adding also a mineral granular material if necessary. However, when such technique is used, a plugging material is diluted with the drilling fluid and circulated together therewith to stick to the surfaces of a pump, supply pipeline, casing pipes and hole walls not always in the places where it is required, without, at any rate, enabling to obtain a permanent non-metal consolidation of walls.

The design of drilling implements in using such techniques is conventional and includes a bit having a passage for drilling fluid attached to a drill pipe string and a hole wall former and centralizer arranged above the bit outside the drill pipe string, which closes the space between the hole walls and the drill pipe string.

This arrangement does not enable the conduct of operations for elimination of complications or case-less consolidation of hole walls without interrupting the drilling process, that is concurrently with the hole drilling.

This is due to the fact that a plugging material is fed to the point of its application to the hole walls in a liquefied, low-concentration form because it should be diluted for being pumped through the whole drill pipe string. This also causes the need to use plugging materials with long hardening time which, in turn, does not permit to the plugging material to gain sufficient strength in the most vital bottom zone.

Still one important disadvantage resides in that during the feeding of an inert filler to the hole, the drilled rock, which exhibits maximum physical and chemical affinity with the rocks forming the hole walls since it is the product of their comminution, is removed out of the hole.

The main object of the invention is to eliminate appearing complications concurrently with continuing drilling of a hole without interrupting the drilling process.

Another object of the invention is to provide for the possibility of non-metal consolidation of the hole walls concurrently with drilling and to obtain non-metallically cased hole or a portion thereof.

Still another object of the invention is to reduce the consumption of expensive plugging materials.

The invention resides in that in an arrangement for full hole drilling, comprising a bit having a passage for admitting drilling fluid to the hole bottom, attached to a drill pipe string, and a hole wall former provided above the bit which closes the space between the hole walls and the drill pipe string, according to the invention, a container containing a plugging material is provided in the interior of the drill pipe string immediately above the bit, which is adapted to let drilling fluid between the walls of the container containing a plugging material and the drill pipe string and to feed a plugging material under the action of a displacing agent, the bit having an axial bore of a diameter which is greater than the inside diameter of the container, the bore being adapted to receive the lower end of the container.

The container is preferably removable for its replacement without lifting the drill pipe string to the surface.

In order to provide for using as filler the rock drilled by the bit, the container may be filled with a plugging material comprising a granular binder for a plugging mix.

The container may comprise a cylindrical pipe which has a removable plug in its lower part and a stemming in the upper part which is adapted to force a plugging material out of the container. The plug is made of a material that can be easily destroyed by the bit during the operation of the arrangement.

The upper end of the container may be provided with a nipple for engaging a hose for handling the container and for feeding a displacing agent thereto.

The above-described arrangement for full hole drilling ensures a continuous drilling of a hole, reliable elimination of complications or non-metal consolidation of the hole walls.

The invention will now be described with reference to a specific embodiment illustrated in the accompanying drawings, in which.

Figure 1:
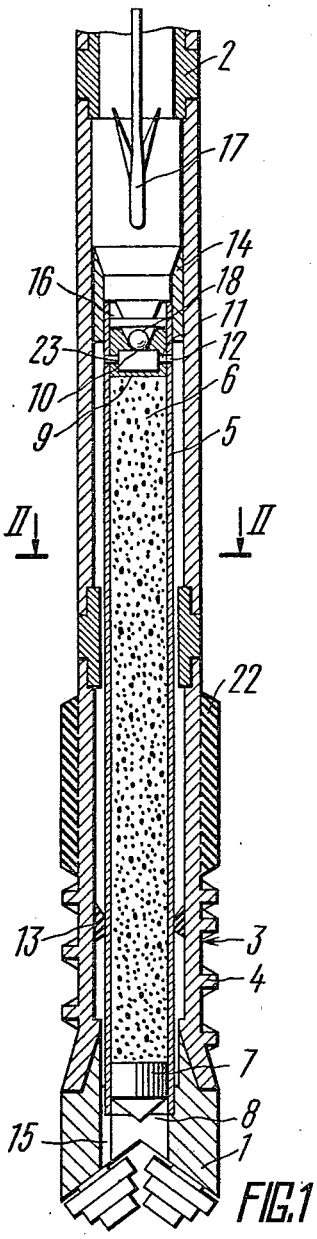
FIG. 1 is a longitudinal section of an arrangement for full hole drilling (in a transportation position) according to the invention.

The arrangement for full hole drilling herein described represents a modification of a conventional drilling equipment and does not make it necessary to introduce any substantial changes; in particular, the bit may comprise any rock breaking tool used in the rotary percussion drilling.

Said arrangement comprises a roller bit 1 which is attached to a drill pipe string 2 (FIG. 1) with the interposition of a former 3.

The former 3 may comprise any structural member which ensures the closure of the space between the hole walls and the drill pipe string, such as an auger 4 having its flights hand opposite to the rotary direction of the drill pipe string 2.

A cylindrical container 5 containing a plugging material 6 is provided in the interior of the drill pipe string 2.

The container 5 may comprise a cylindrical pipe which is plugged at bottom and top, a cylindrical sealed bulb made of a plastic material or a rod made of a pressed plugging material having the surface encapsulated (waterproofed) with a waterproofing layer. The container may be integral with the bit or, which is preferred, it may be removable for its replacement without withdrawing the bit from the hole.

The plugging material 6 may comprise a dry quick-setting mix, such as a gypsum and cement mix, a paste-like mixture of various polymeric materials with hardeners, cement, polymerizable, clayey and like pulverulent materials which are conventionally used as binders.

The lower end of the container 5 is sealed with a plug 7 (change plug made from a readily destroyable material) and co-operates with a central bore 8 of the roller bit 1 destroying the plug 7 after it is pushed out of the container 5, and the upper end of the container 5 is sealed with a stemming 9 which may have different embodiments, for instance, like the one shown in FIG. 1 and having an inlet opening 10 which simultaneously acts as a valve seat and an outlet opening 11, and the container 5 has an opening 12 aligned with the opening 11 for the passage of drilling fluid into the space between the container 5 and the inner walls of the drill pipe string 2 which has locating members 13 for guiding and centering the container 5. The top locating member may comprise a continuous ring 14 having its central opening diameter equal to the outside diameter of the container 5, and the remaining locating members comprise individual projections. The body of the roller bit 1 has a passage 15 for admitting drilling fluid to the hole bottom when the bore 8 of the bit 1 is closed by the container 5. The upper portion of the container 5 has a socket 16 for engagement with an end piece of a fishing device 17. For forcing the material 6 from the container 5, a ball 18 is thrown into the interior of the drill pipe string to close the opening 10 of the stemming 9.

Figure 3:
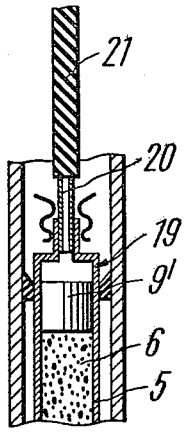
FIG. 3 is an embodiment of an independent supply of a displacing agent.
Figure 2:
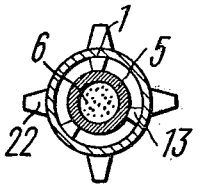
FIG. 2 is a sectional view taken along the line II—II in FIG. 1.

In another embodiment illustrated in FIG. 3 the stemming 9' comprises a cylindrical piston plug and a device for engaging and sealing an end piece 20 of a cable-hose 21 which is designed for handling the container 5 and for feeding the displacing fluid.

The above-described structural arrangements do not exhaust all possible modifications of the arrangement according to the invention. In practice, the arrangement may comprise a terminal portion of a conventional drilling string, with the replacement of the container 5 containing the plugging material being possible only after the withdrawing of the whole drilling string to the surface.

These modifications do not, however, affect the structural features of the arrangement according to the invention and are mainly concerned with methods of operation of the arrangement and some minor structural modifications of secondary components.

The arrangement for full hole drilling functions in the following manner.

Under normal drilling conditions, drilling fluid is admitted through openings 10, 11 of the stemming 9 and the opening 12 of the container 5, intertube space between the container 5 and the inner walls of the drill pipe string 1 and along the passage 15 to the bit 2 and to the hole bottom.

Upon the occurrence of a complication, such as water absorption and loss of drilling fluid, a steel ball 18 is thrown into the interior of the drill pipe string and the ball falls to the end of the stemming 9 to close the opening 10 thereby sealing-off the passage for drilling fluid to the intertube space. Pressure of drilling fluid inside the drill pipe string abruptly increases over the stemming 9 so as to shear pins 23 retaining the stemming 9 which is forced down through the container 5 to force out, through the plugging material 6, the plug 7 and to open the outlet for admission of the plugging material 6 to the bit 1 whereby the plug 7 is destroyed by the bit 1. After having forced out the plug 7 and a portion of the plugging material 6, the stemming 9 which continues to move down through the container 5 opens the opening 12 in the wall of the container 5 so as to provide for normal supply of drilling fluid to the drilling bit 1. The plugging material 6 crushed and ground by the rollers of the bit 1 is mixed with the drilled rock and drilling fluid and is concentrated by the flights of the auger 4 of the former 3 in the lower portion of the hole adjacent to the hole bottom to be thrown against the hole walls. Centrifugal forces and the pressure of the drilling implement squeeze out an excess of water from the mass. A thick and viscous mass of the plugging material 6 filled with broken rock is forced into voids and seams of the rocks forming the hole walls, compacted and starts hardening.

A rubbing member 22 floats the plugging material 6 and sizes the hole shaft so as to effect an additional compaction of the mass to dehydrate it and to cut off an excess of the mass.

After all plugging material 6 is consumed, a fishing device 17 is lowered on a rope to engage with its end pieces the socket 16, to withdraw the container 5 and to replace it with a fresh container.

The plugging process is repeated if necessary until the complication is completely eliminated.

In another preferred embodiment of the arrangement having the device 19 shown in FIG. 3 for engaging and sealing the end piece 20 of the cable-hose 21, the plugging material 6 is forced out with a displacing agent (fluid or gas), the cable-hose being also used for lowering and lifting the container 5.

It will be apparent that the replacement of the container 5 immediately adjacent to the hole bottom as described above is only possible if permitted by the design and dimensions of members of the drilling string 1. Such replacement is, therefore, preferred in drilling large-diameter holes such as of a diameter larger than 112 mm. In drilling holes of smaller diameter, it is more preferable to replace the containers 5 at the surface level and, if possible, simultaneously with the replacement of the bit tip so that the container 5 is to be chosen to contain such quantity of a plugging material 6 which is enough for drilling an interval of the hole drilled with one bit. This reduced time loss for lifting and lowering operations.

In case the arrangement according to the invention is used for non-metal consolidation of hole walls by providing a proofing layer over the entire surface of the hole, the plugging material 6 is continuously forced out during the hole drilling. When the plugging material is consumed, the drilling is interrupted, the container 5 is replaced, and the drilling begins anew to a desired depth.

An intense mixing of the drilled rock with the plugging material occurs, the rock functioning as an inert aggregate and, owing to the affinity thereof with the rocks forming the hole walls, improving the quality of the proofing system and reducing the consumption of the plugging material fed to the hole bottom.

It should be emphasized that since a part of the broken rock which is mixed with the plugging material functioning as a binder is a component—filler—of the plugging material, the plugging material 6 is saved and the quality of sealing of the absorption channels or consolidation of the hole wall is improved since the similarity of composition of the filler and the rock forming the hole walls enable their better cohesion.

The invention may be used in eliminating complications in the full hole drilling, for non-metal consolidation of the hole walls which is effected concurrently with drilling, in making wells and chambers, in enlarging and repairing earlier drilled holes, in drilling through unstable intervals of holes in uncemented sands, swelling and soaking clays, etc.

We claim:

1. An arrangement for a full hole drilling, comprising: a drill pipe string; a bit attached to the drill pipe string; a passage for admitting drilling fluid to the hole bottom provided in said bit; a hole wall former provided above the bit and adapted to close the space between the hole walls and the drill pipe string; a container containing a plugging material provided in the interior of said drill pipe string immediately above said bit; said container being made removable so that it can be replaced without lifting said drill pipe string to the surface and adapted to admit drilling fluid between the walls of said container and said drill pipe string and to supply the plugging material to said bit under the action of a displacing agent; an axial bore made in said bit, having a diameter which is greater than the inner diameter of said container, and housing the lower end portion of said container and adapted to admit the plugging material to the hole bottom.

2. An arrangement according to claim 1, wherein said container comprises a cylindrical pipe having in its lower portion a plug and a stemming in its upper portion, which is adapted to force said plugging material out of said container through said bore of the bit.

3. An arrangement according to claim 2, wherein the upper end of said container is provided with a nipple and there is provided a hose adapted to engage said nipple for handling the container and for feeding a displacing agent therein.

4. An arrangement according to claim 1, wherein said container is filled with a plugging material comprising a granular binder.

5. An arrangement for a full hole drilling, comprising: a drill pipe string; a bit attached to the drill pipe string; a passage for admitting drilling fluid to the hole bottom provided in said bit; a hole wall former provided above the bit and adapted to close the space between the hole walls and the drill pipe string; a container containing a plugging material comprising a granular binder provided in the interior of said drill pipe string immediately above said bit; said container being adapted to admit drilling fluid between the walls of said container and said drill pipe string and to supply the plugging material to said bit under the action of a displacing agent; an axial bore made in said bit, having a diameter which is greater than the inner diameter of said container, and housing the lower end portion of said container and adapted to admit the plugging material to the hole bottom.

* * * * *